US009717299B2

(12) United States Patent
Itoi

(10) Patent No.: US 9,717,299 B2
(45) Date of Patent: Aug. 1, 2017

(54) TEXTILE

(71) Applicant: ITOI Lifestyle Research Co., Kishiwada-shi, Osaka (JP)

(72) Inventor: Toru Itoi, Osaka (JP)

(73) Assignee: ITOI LIFESTYLE RESEARCH CO., Osaka (JP)

( * ) Notice: Subject to any disclaimer, the term of this patent is extended or adjusted under 35 U.S.C. 154(b) by 497 days.

(21) Appl. No.: 14/513,509

(22) Filed: Oct. 14, 2014

(65) Prior Publication Data

US 2015/0104592 A1 Apr. 16, 2015

(30) Foreign Application Priority Data

Oct. 15, 2013 (JP) ..... 2013-214917
Apr. 7, 2014 (JP) ..... 2014-078579

(51) Int. Cl.

| | |
|---|---|
| ***B29D 22/00*** | (2006.01) |
| ***A43B 1/06*** | (2006.01) |
| ***D03D 1/00*** | (2006.01) |
| ***D03D 13/00*** | (2006.01) |
| ***D03D 15/00*** | (2006.01) |
| ***A43B 1/00*** | (2006.01) |
| ***A43B 1/04*** | (2006.01) |
| ***A43B 23/02*** | (2006.01) |

(52) U.S. Cl.

CPC ..... *A43B 1/06* (2013.01); *A43B 1/0045* (2013.01); *A43B 1/04* (2013.01); *A43B 23/0225* (2013.01); *A43B 23/0255* (2013.01); *D03D 1/00* (2013.01); *D03D 13/004* (2013.01); *D03D 13/008* (2013.01); *D03D 15/0027* (2013.01); *D03D 15/0072* (2013.01); *D03D 15/0088* (2013.01); *D10B 2201/01* (2013.01); *D10B 2501/043* (2013.01); *Y10T 428/1334* (2015.01); *Y10T 428/1362* (2015.01); *Y10T 442/3154* (2015.04); *Y10T 442/3179* (2015.04)

(58) Field of Classification Search

CPC ..... A43B 1/06; D03D 3/008; D03D 15/0027
USPC ..... 428/35.2
See application file for complete search history.

(56) References Cited

U.S. PATENT DOCUMENTS

| | | | | |
|---|---|---|---|---|
| 6,506,697 | B1 | 1/2003 | Samel | |
| 2012/0238167 | A1 * | 9/2012 | Ban | D02G 3/08 442/139 |

FOREIGN PATENT DOCUMENTS

| | | | |
|---|---|---|---|
| CN | 1986925 | A | 6/2007 |
| JP | S60-215837 | A | 10/1985 |
| JP | 08-182504 | A | 7/1996 |
| JP | 3059918 | U | 7/1999 |
| JP | 2001-254244 | A | 9/2001 |
| JP | 2002-194642 | A | 7/2002 |
| JP | 2003-073956 | A | 3/2003 |
| JP | 2004-124311 | A | 4/2004 |
| JP | 2005-192724 | A | 7/2005 |

OTHER PUBLICATIONS

International Search Report for the corresponding PCT application No. PCT/JP2014/077352, dated Jan. 13, 2015.
Extended European Search Report for the corresponding European patent application No. 14 188 189.8, dated Jan. 30, 2015.
Notice of Allowance of the corresponding Japanese Patent Application No. 2014-078579, dated Jul. 14, 2014.

* cited by examiner

*Primary Examiner* — Hui Chin
(74) *Attorney, Agent, or Firm* — Global IP Counselors, LLP

(57) ABSTRACT

A textile with high weave density which comprises a main-yarn made of a Japanese paper yarn and a sub-yarn thinner than the main-yarn interwoven with each other, wherein the textile has a weave texture structure including warps A and wefts A made of the main-yarn, and warps B and wefts B made of the sub-yarn, wherein in the weave texture structure, warp rows have a repeating row structure where a plurality of warps B are located between two warps A and weft rows have a repeating row structure where a plurality of wefts B are located between two wefts A, and wherein the warps A and the wefts A cross each other in a plain weave texture structure.

18 Claims, 6 Drawing Sheets

TEXTILE

CROSS-REFERENCE TO RELATED APPLICATIONS

This application claims priority to Japanese Patent Application No. 2013-214917 filed on Oct. 15, 2013 and Japanese Patent Application No. 2014-078579 filed on Apr. 7, 2014. The entire disclosures of Japanese Patent Application No. 2013-214917 and Japanese Patent Application No. 2014-078579 are hereby incorporated herein by reference.

BACKGROUND

Technical Field

The present invention relates to a textile having moisture absorption properties and durability as well as good texture, which is used for articles including Japanese paper as a material. More particularly, the present invention relates to a textile which can be suitably used for running shoes and the like which have excellent durability and cause less damage on the foot.

Related Art

To increase the durability of running shoes, the primary focus is placed on an improvement of shoe soles. Formation of a shoe sole having an integrated structure is disclosed in which ridge-like projections provided on a bottom end face of a midsole are fitted/fixed to grooves formed in the bottom of an outsole (for example, Japanese Unexamined Patent Application Publication No. 08-182504). For athletic running shoes, especially for long-distance running shoes, however, damage of the upper part is also taken seriously as a result of the pursuit of the maximum possible weight reduction. The damage on the foot due to the pursuit of durability must also be avoided. For example, the trouble that the moisture in shoes during sports softens the skin to produce corns followed by breaking of corns or so must be avoided.

As upper materials to reduce the moisture in shoes, fabrics made of fibers excellent in moisture absorption properties and quick-drying may be considered. Even if fibers with relatively high moisture absorption properties, such as cotton and rayon, are used, the trouble that the moisture in shoes softens the skin to produce corns followed by breaking of corns or so cannot be avoided under severe use conditions in fact. Synthetic fibers such as polyester and nylon may have satisfactory strength but have poor moisture absorption properties, so that the trouble that the moisture in shoes during sports softens the skin to produce corns followed by breaking of corns or so cannot be avoided.

As materials of yarns having both moisture absorption properties and high strength, yarns including Japanese paper may be considered (see, for example, Japanese Unexamined Patent Application Publication No. 2005-192724). When a textile of plain weave texture as disclosed in Japanese Unexamined Patent Application Publication No. 2005-192724 or the like produced by using a yarn made simply from Japanese paper, or a textile obtained by passing a yarn made of Japanese paper as a weft through a yarn made of a synthetic fiber for reinforcement and the like as a warp is used as an upper material, there may be concerns about problems of the durability under hard sports and the skin damage of the foot.

SUMMARY

It is an object of the present invention to provide a textile having moisture absorption properties and durability as well as good texture, which is used for articles including Japanese paper as a material.

It is another object of the present invention to provide running shoes which have excellent durability and cause less damage on the foot.

According to a first preferred aspect of the present invention, there is provided a textile which comprises a main-yarn and a sub-yarn interwoven with each other, wherein the main-yarn is a yarn including 50% by weight or more of Japanese paper which is slit into a tape shape, the sub-yarn is a yarn made of natural fiber for spinning and weaving, or made of artificial fiber, the sub-yarn having a weight per unit length that is 1/7 to 2/3 of the weight per unit length of the main-yarn, the textile has a weave texture structure including a warp A made of the main-yarn, a weft A made of the main-yarn, a warp B made of the sub-yarn, and a weft B made of the sub-yarn, wherein in the weave texture structure, warp rows have a repeating row structure where one or two warps B are located between two warps A, weft rows have a repeating row structure where one or two wefts B are located between two wefts A, and the warp A and the weft A cross each other in a plain weave texture structure or twill weave texture structure in the texture, the textile has a weave density coefficient of 8.5 to 14, and the textile has a value of t/P of 1/15 to 1/4 where P represents a product of the number of warps and the number of wefts, the warps and the wefts being present in a unit area of the textile, and t represents the number of floats in which the number of skipped yarns by the main-yarn is 3 to 4, the floats being present on one side of the unit area.

According to a second preferred aspect of the present invention, a value of $2\times|W_1-W_2|/(W_1+W_2)$ may be 0 to 0.15, where $W_1$ represents a warp density of the textile and $W_2$ represents a weft density of the textile.

According to a third preferred aspect of the present invention, in the textile, the sub-yarn may include a heat-fusible fiber, the heat-fusible fiber may include a hot-melt polymer, and a heat-fusion property of the heat-fusible fiber may be exhibited by melting the hot-melt polymer.

According to a fourth preferred aspect of the present invention, in the textile, the main-yarn may be a composite yarn containing the Japanese paper and a heat-fusible fiber, the heat-fusible fiber may include a hot-melt polymer, and a heat-fusion property of the heat-fusible fiber may be exhibited by melting the hot-melt polymer.

According to a fifth preferred aspect of the present invention, in the textile, the heat-fusible fiber may be a composite fiber of the hot-melt polymer and a high melting point polymer having a higher melting point than the hot-melt polymer, and the composite fiber may be a composite fiber obtained by combining the high melting point polymer and the hot-melt polymer in a core-sheath structure or bimetal structure.

According to a sixth preferred aspect of the present invention, the textile is obtained by heating the textile at a temperature at which the hot-melt polymer melts.

According to a seventh preferred aspect of the present invention, a fabric member for footwear using the textile is provided.

According to an eighth preferred aspect of the present invention, a shoe using the textile for an upper is provided.

According to a ninth preferred aspect of the present invention, a sandal using the textile for a fabric member is provided.

According to a tenth preferred aspect of the present invention, a bag using the textile for a bag part is provided.

According to an eleventh preferred aspect of the present invention, a case using the textile for a storage part is provided.

According to a twelfth preferred aspect of the present invention, a garment using the textile as a fabric is provided.

According to a thirteenth preferred aspect of the present invention, an interior material for movable bodies, using the textile as a fabric, is provided.

According to a fourteenth preferred aspect of the present invention, an insole using the textile as a fabric is provided.

According to a fifteenth preferred aspect of the present invention, an article material for interiors, using the textile as a fabric, is provided.

The present invention provides a textile having moisture absorption properties and durability as well as good texture, which is used for articles including Japanese paper as a material.

The present invention provides running shoes which have excellent durability and cause less damage on the foot.

For a full understanding of the present invention, reference should now be made to the following detailed description of the preferred embodiments of the invention as illustrated in the accompanying drawings.

DETAILED DESCRIPTION OF EMBODIMENTS

Figure 1:
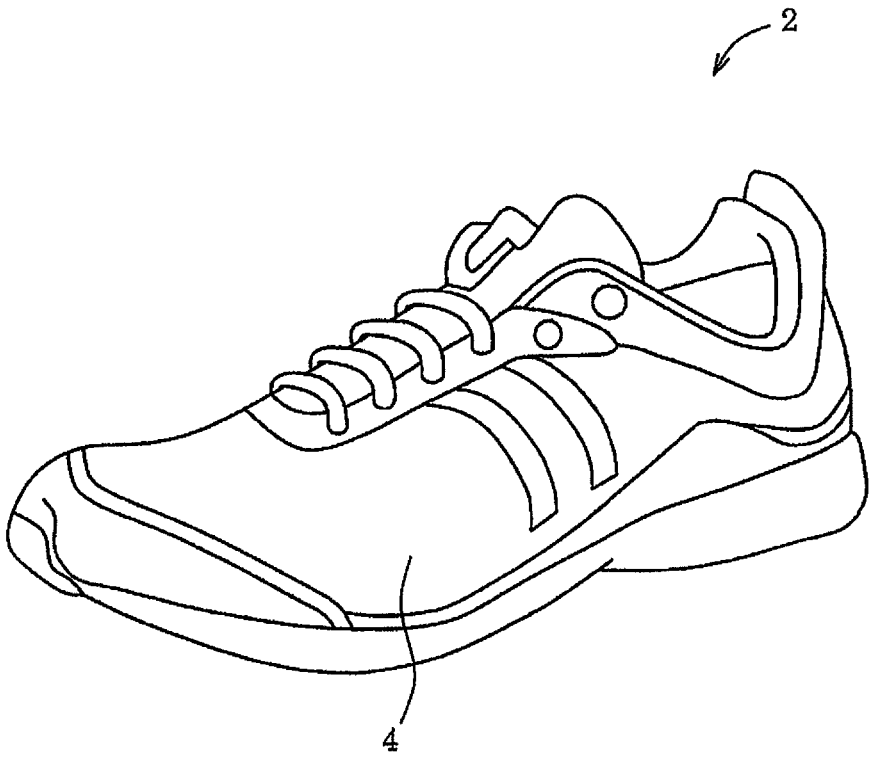
FIG. 1 is a perspective view of a structure of a running shoe.

The preferred embodiments of the present invention will now be described with reference to FIGS. 1 to 6. Identical elements in the figure are designated with the same reference numerals.

The textile of the present invention is a textile using a yarn mainly containing Japanese paper. The textile of present invention is used for an upper 4 of a running shoe 2 as illustrated in FIG. 1 or the like.

Japanese paper is obtained by papermaking using a Japanese paper material including a fiber obtained by beating raw material plants suitable for Japanese paper, such as paper mulberry, oriental paper bush, hemp, conifer, and bamboo grass. The weight per unit area of Japanese paper is about 10 to 20 g/m$^2$. The Japanese paper used in the present invention may include 10% by weight or less of other fibers than the above Japanese paper materials. When the content of fibers other than the above Japanese paper materials is over 10% by weight, the moisture absorption properties and strength specific to Japanese paper may decrease to affect the characteristics of products such as running shoes in the present invention. In the Japanese paper used in the present invention, the content of the above Japanese paper materials is most preferably 95% by weight or more.

A yarn mainly containing the Japanese paper used in the present invention (hereinafter, referred to as a Japanese paper yarn) is preferably produced by twisting a Japanese paper tape obtained by slitting Japanese paper into a tape shape of thin width (for example, 1 to 5 mm in width). The Japanese paper yarn may be a twisted yarn of a Japanese paper tape and a different yarn(s), but needs to include 50% by weight or more of Japanese paper. The Japanese paper yarn more preferably includes 70% by weight or more of Japanese paper. The Japanese paper yarn may be a yarn obtained by covering a Japanese paper tape with a different yarn(s), or a yarn obtained by covering a different yarn(s) with a Japanese paper tape. When the ratio of the yarn(s) other than the Japanese paper (different yarn(s)) in the Japanese paper yarn is over 50% by weight, it affects favorable moisture absorption properties and absence of moisture feeling of products such as running shoes in the present invention. The Japanese paper yarn preferably consists of only Japanese paper. The Japanese paper yarn may be a single yarn or a two folded yarn. The linear density (weight per unit length) of the Japanese paper yarn is preferably from 1/60 (g/m) to 1/10 (g/m). That is, the metric count of the yarn is preferably from yarn number count of 10 to 60 for a single yarn. The Japanese paper yarn is preferably twisted in order to obtain strength and an appearance of uniform textile surface. When the number of twists T of the Japanese paper yarn (turn/m) is $K_W \times \sqrt{N}$ (wherein N is a metric count of the Japanese paper yarn), the twist constant $K_W$ is preferably from 50 to 160.

In the textile of the present invention, a reinforcing yarn for improving the tensile strength of the textile is used in addition to the Japanese paper yarn. The reinforcing yarn is used with being interwoven with the Japanese paper yarn. The reinforcing yarn is preferably a filament yarn or a spun yarn made of artificial fibers such as polyester, nylon, and rayon in terms of the strength. The reinforcing yarn may be a spun yarn or a filament yarn made of natural fibers for spinning and weaving, such as cotton, hemp, and silk.

Although it is preferred to use this reinforcing yarn as a warp and pass the Japanese paper yarn through the reinforcing yarn as a weft in terms of weavability, the textile obtained by this method has a large difference in shearing rigidity and bending rigidity between the length and the width of the textile. This decreases dimensional stability when the textile is used for the upper 4 and also decreases deformation balance, causing a problem of difficulty of making a curved surface suitable for the upper 4. In addition, most of the reinforcing yarn is also exposed on a surface of the textile, and thus a large proportion of the reinforcing yarn directly touches the foot when the shoes are worn, causing a problem with the purpose to solve the moisture feeling. The present invention has been made to solve these problems.

Figure 2:
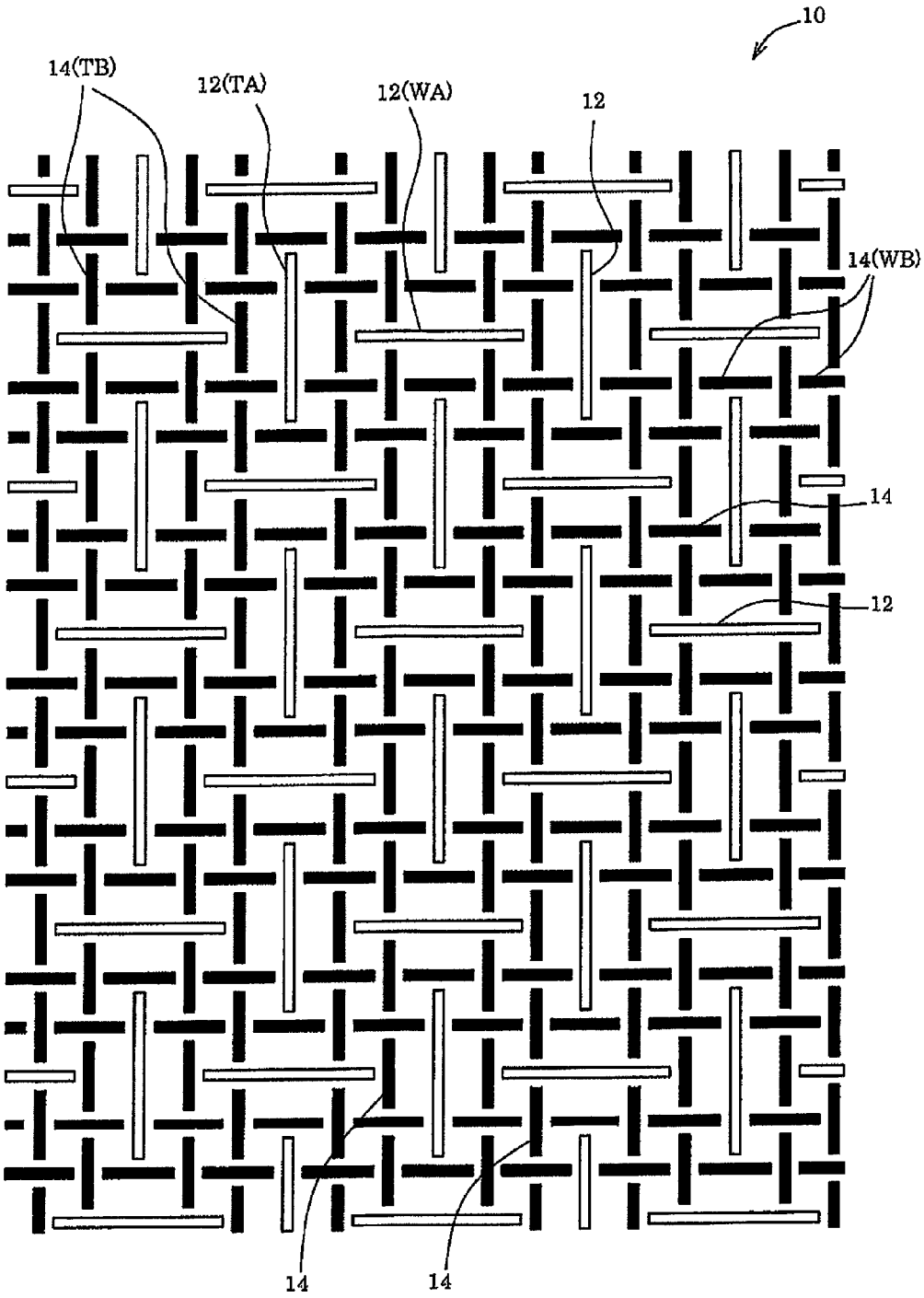
FIG. 2 is an explanatory diagram illustrating a texture of the textile of the present invention.

An exemplary weave texture chart of the textile of the present invention using the above-mentioned Japanese paper yarn is illustrated in FIG. 2. The textile of the present invention is a textile obtained by interweaving a main-yarn with a sub-yarn and has a weave texture of a main-yarn 12 and a sub-yarn 14 in a weave texture chart 10, as illustrated in FIG. 2. The main-yarn 12 is a Japanese paper yarn, and the sub-yarn 14 has a weight per unit length that is 1/7 to 2/3 of the weight per unit length of the main-yarn 12. The sub-yarn in the present invention, such as the sub-yarn 14, is a yarn used as the above-mentioned reinforcing yarn. The sub-yarn 14 is preferably a filament yarn because of less fluff of products and a small volume of the yarn. Less fluff of products reduces damage on the foot due to the friction between the products and the foot during the use of the products, and a small volume of the yarn makes it difficult to expose the sub-yarn 14 on the surface of the textile, reducing the contact area between the sub-yarn and the foot during the use of the products. This can increase the contact area between the main-yarn 12 and the foot during the use of the products.

Figure 3:
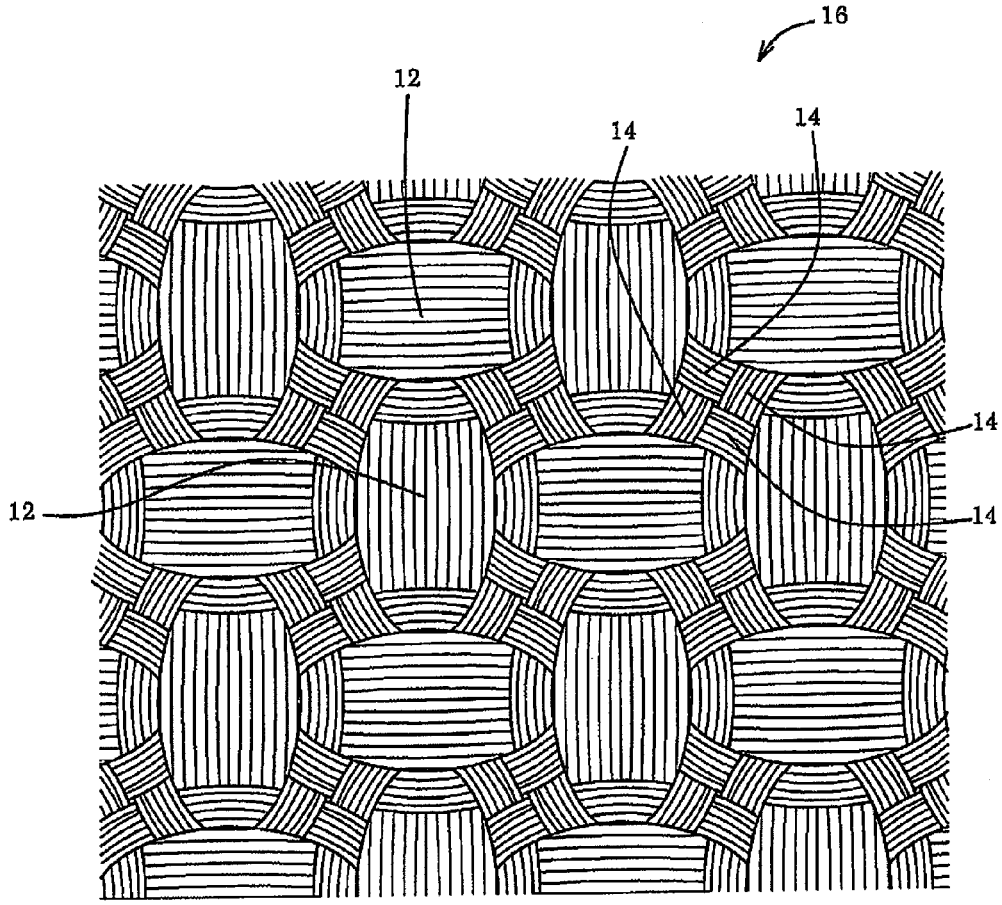
FIG. 3 is a schematic view illustrating the condition of a surface of the textile of the present invention.

The textile of the present invention illustrated in the weave texture chart 10 has a weave texture structure where a warp TA made of the main-yarn 12 and a weft WA made of the main-yarn 12 are interwoven with a warp TB made of the sub-yarn 14 and a weft WB made of the sub-yarn 14. Focusing only on both the warp TA and the weft WA in this weave texture structure, they cross each other in a plain weave texture structure in the texture. Furthermore, warp rows have a repeating row structure where two warps TB are located between two warps TA (adjacent warps TA when the warps TB are ignored); whereas weft rows have a repeating row structure where two wefts WB are located between two wefts WA (adjacent wefts WA when the wefts WB are ignored). The textile used in the present invention has this weave texture and increases weave density to provide a textile 16 having a structure where the main-yarn 12 occupies a larger surface of the textile than the sub-yarn 14 does, as illustrated in FIG. 3.

Japanese paper yarn easily becomes flat as compared with yarns made of natural fibers for spinning and weaving, such as cotton yarns, when it is woven according to the weave texture structure in the textile of the present invention. For this reason, the textile 16 having a structure where the main-yarn 12 advantageously occupies a larger surface of the textile than the sub-yarn 14 is obtained.

When long-distance runners wear the running shoes using the textile of the present invention for an upper, the moisture from sweating is quickly absorbed to the textile from a side in contact with the foot due to high moisture absorption properties of Japanese paper, and the absorbed moisture is quickly released to the outside air from the opposite side of the texture to the side in contact with the foot. Accordingly, shoes with no moisture feeling are obtainable by using the textile of the present invention for an upper.

Conventional running shoes are designed to facilitate the release of moisture from sweating to the outside by increasing the opening size of the textile used for an upper. In this case, however, an adverse effect may arise such that rainwater easily enters the shoes, when it rains, and this rainwater makes the inside of the shoes soggy. Since the textile of the present invention has a relatively high weave density, rainwater hardly enters the shoes and the moisture from sweating is quickly absorbed to the textile from the side in contact with the foot, and the absorbed moisture is quickly released to the outside air from the opposite side of the texture to the side in contact with the foot. Accordingly, the shoes with no moisture feeling even for use in rainy days are obtainable by using the textile of the present invention for an upper.

When the Japanese paper used in the textile of the present invention is mixed with a fiber of bamboo grass, the running shoes using this textile for an upper have antibacterial properties and thus have the effect of reducing rash of the foot.

Examples of textiles using two kinds of yarns with one of the yarns being mainly exposed on a surface include those having a double weave texture, but these textiles increase the weight per unit area and are thus unsuitable for materials for running shoes requiring weight reduction. One of the yarns may be exposed on the surface by being floated by the sateen weave texture, but there are fewer intersections between the warp and the weft, which decreases the resistance (shear modulus) of the textile 16 to the shear force in a plane direction. This decreases dimensional stability when this textile is used for the upper 4 and also decreases deformation balance because of different bending elastic modulus of the textile 16 for each bending direction, making it difficult to make a curved surface suitable for the upper 4. It is also difficult to keep the shape in use.

Focusing only on the warp TA and the weft WA that are the main-yarns 12 with regard to the textile 16, as described above, they cross each other in a plain weave texture structure, and the sub-yarns 14 have many intersections between the warp and the weft, which are similar to the plain weave texture structure, and these intersection are provided in a well-balanced manner. This substantially equalizes the longitudinal and traverse tensile elasticities of the textile 16 to provide favorable balance. When the number of intersections between the warps (warps TA and TB) and the wefts (wefts WA and WB) which are present in the unit area (for example, 1 cm×1 cm) of the textile 16 (the product of the number of the warps and the number of the wefts in the unit area) is represented by P, and the number of floats, in which the number of skipped yarns is 4, of the main-yarn present in one side of the textile 16 (the side in which the exposed area of the main-yarns is larger than that of the sub-yarns, or the side in which the exposed areas of the main and sub-yarns are the same, i.e., the visible surface side of the drawings in FIGS. 2, 5, and 6) in that area is represented by t, t/P is 1/9.

Figure 4:
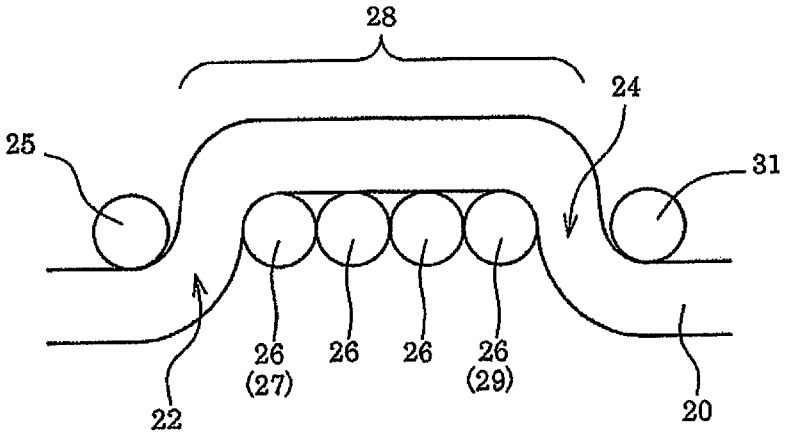
FIG. 4 is a cross-sectional schematic view for describing the terms related to the textile texture.

In this specification, the number of skipped yarns, as illustrated in a cross-sectional schematic view of FIG. 4, refers to the number F of yarns 26 crossing a yarn 20 between an intersection 22 of the yarn 20 and another intersection 24 adjacent to the intersection 22 with regard to the yarn 20 in the textile texture. When F is 2 or more, a portion of the yarn 20 between one intersection 22 and another intersection 24 is referred to as a float 28. The intersection refers to any pass point through which a yarn (for example, the yarn 20) to cross two adjacent parallel yarns (for example, yarns 25 and 27) passes between the adjacent parallel yarns in the textile texture. That is, the intersection refers to any pass point through which a weft passes between two adjacent warps, or any pass point through which a warp passes between two adjacent wefts. The intersection 22 is a pass point through which the yarn 20 passes between the yarns 25 and 27, and the intersection 24 is a pass point through which yarn 20 passes between the yarns 29 and 31. FIG. 4 illustrates the float 28 in which the number F of skipped yarns is 4.

When the t/P is 1/9 and the sub-yarn 14 has a weight per unit length that is 1/7 to 2/3 of the weight per unit length of the main-yarn 12 in the textile 16, the textile 16 has a structure where the exposed area ratio of the main-yarn 12 is larger than that of the sub-yarn 14 as illustrated in FIG. 3. Accordingly, the textile 16 can obtain exposure of the main-yarn on the surface; and preferred deformation characteristics to make a curved surface suitable for the upper 4, i.e., high bending elasticity, particularly high shear elasticity in the plane direction, and the above-mentioned balanced longitudinal and traverse tensile elasticities as described above. The textile 16 can also obtain a smooth surface. It is more preferred for the sub-yarn 14 to have a weight per unit length that is 1/5 to 1/2 of the weight per unit length of the main-yarn 12 when the exposed area ratio of the main-yarn 12 is larger than that of the sub-yarn 14.

In the textile 16, the number of skipped yarns in the float of the main-yarn 12 is 4 or less, which also contributes to high shear elasticity in a plane direction and balanced longitudinal and traverse tensile elasticities.

Furthermore, in the textile 16, the number of skipped yarns in the float of the sub-yarn 14 is 2 or less, which also contributes to substantially equal longitudinal and traverse tensile elasticities in the textile 16 to provide favorable balance, and contributes to high shear elasticity in the plane direction, the dimensional stability, and the above-mentioned balanced longitudinal and traverse tensile elasticities described above. This also contributes to good shape stability of the textile 16.

In addition to this, the textile 16 has a structure where the main-yarns 12 are located so as to cover a surface of the textile, as described above, and thus the main-yarns 12 excellent in moisture absorption properties are used in contact with runners' foot. This can avoid the trouble that the moisture in shoes during sports softens the skin to produce corns followed by breaking of corns or so.

Japanese paper usually has higher strength when it is wet than when it is dried. The running shoe 2 of the present invention accordingly has much higher durability than running shoes using rayon yarns, yarns made of synthetic fiber, and the like for upper materials, which allows repeated use. The running shoes using a fabric made only of a yarn made of synthetic fiber for an upper may undergo creep deformation and strength decrease by the temperature rising when in use to cause deformation and damage; whereas wet Japanese paper hardly causes strength decrease or deformation by the temperature rising when in use.

Figure 5:
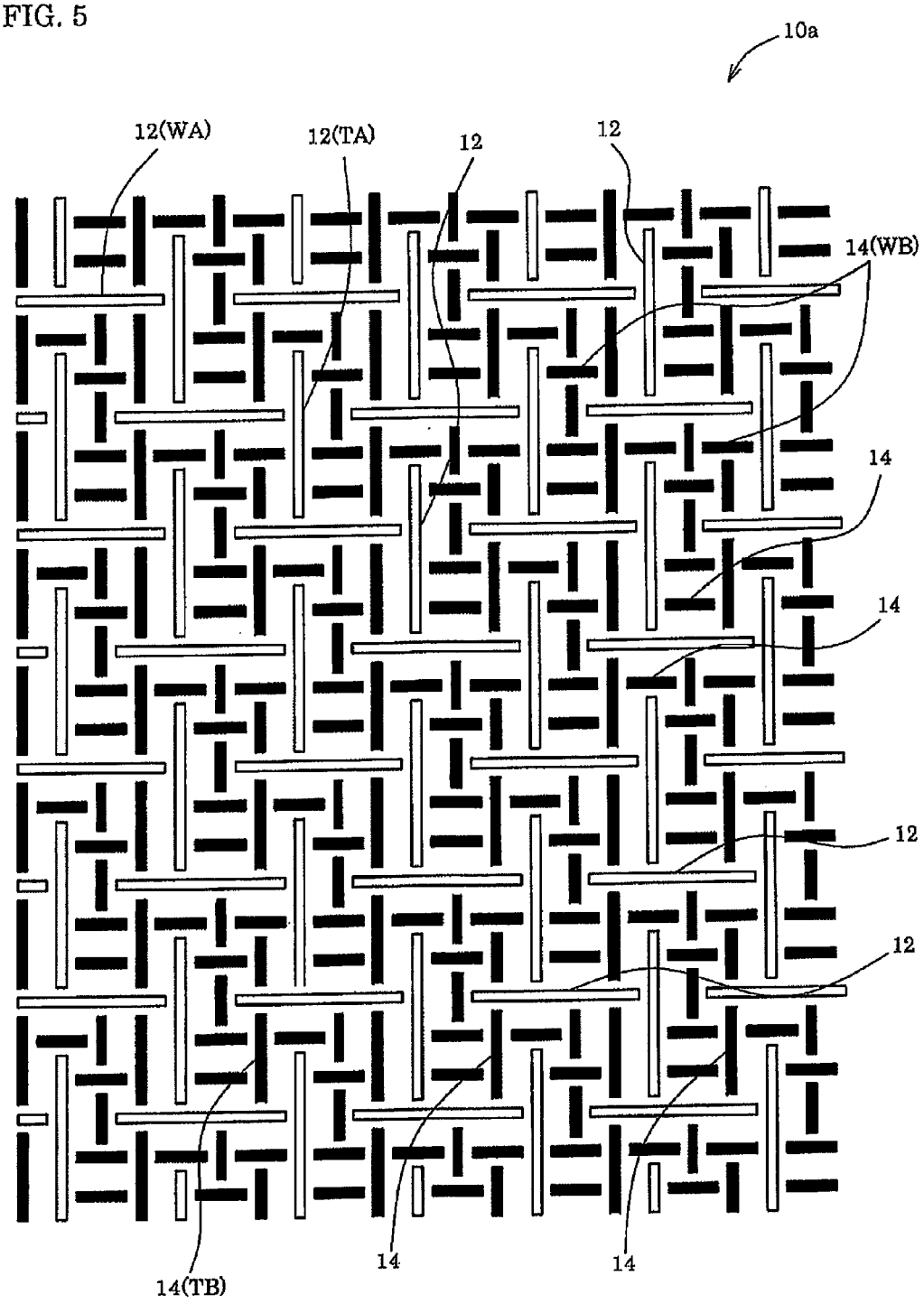
FIG. 5 is an explanatory diagram illustrating a texture different from that in FIG. 2 of the textile of the present invention.

A weave texture chart 10*a* of a textile in another aspect of the present invention is illustrated in FIG. 5. In this aspect, the textile has a weave texture structure where a warp TA made of the main-yarn 12 and a weft WA made of the main-yarn 12 are interwoven with a warp TB made of the sub-yarn 14 and a weft WB made of the sub-yarn 14. Focusing only on both the warp TA and the weft WA in this weave texture structure, they cross each other in a plain weave texture structure in the texture. Warp rows have a repeating row structure where two warps TB are located between two warps TA; whereas weft rows have a repeating row structure where two wefts WB are located between two wefts WA. In addition, the value of t/P is 1/9.

Moreover, in the textile according to the weave texture chart 10*a*, the number of skipped yarns in the float of the sub-yarn 14 on one side is 2 or less. This also contributes to substantially equal longitudinal and traverse tensile elasticities in the textile to provide favorable balance, and further contributes to high shear elasticity in a plane direction, dimensional stability, and the above-mentioned balanced longitudinal and traverse tensile elasticities described above. This also contributes to good shape stability of the textile.

In the weave texture chart 10*a* with such a configuration, an increase in weave density realizes a structure where the main-yarns 12 are located so as to cover the surface of the textile and the sub-yarns 14 are located in the central portion of the textile in a thickness direction. In the same manner as in the textile 16 illustrated in FIG. 3, the texture has preferred deformation characteristics to make a curved surface suitable for the upper 4, i.e., high bending elasticity, particularly high shear elasticity in the plane direction, and the above-mentioned balanced longitudinal and traverse tensile elasticities as described above. In addition to these, the textile has a structure where the main-yarns 12 are located so as to cover the surface of the textile, as described above, and thus the main-yarn 12 excellent in moisture absorption properties is used in direct contact with runners' foot. This can avoid the trouble that the moisture in shoes during sports softens the skin to produce corns followed by breaking of corns or so. These preferred deformation characteristics also reduce the shape deformation of the upper 4 due to the use of the shoes and also contributes to good durability of the shoes.

Figure 6:
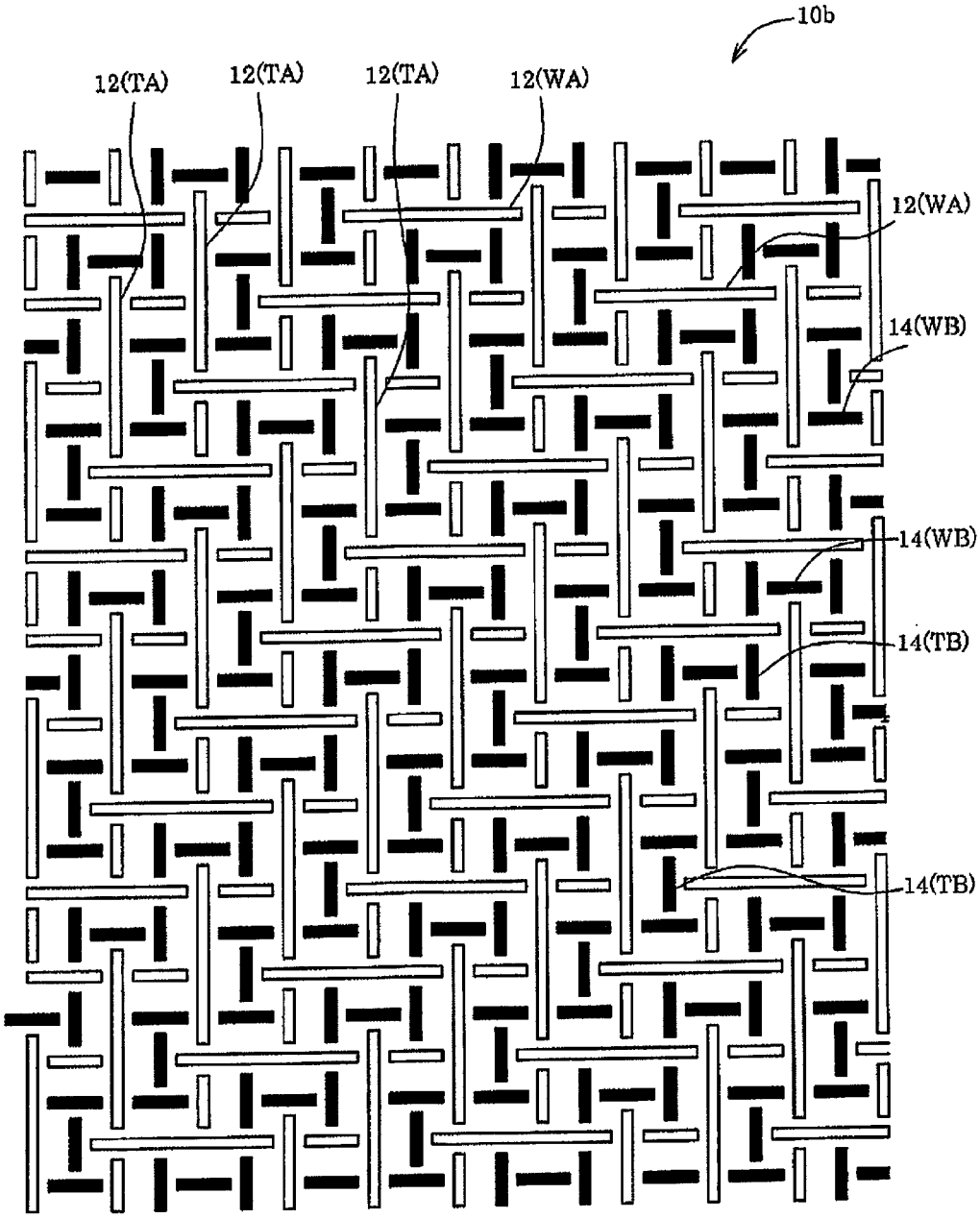
FIG. 6 is an explanatory diagram illustrating a texture different from that in FIG. 5 of the textile of the present invention.

A weave texture chart 10*b* of a textile in still another aspect of the present invention is illustrated in FIG. 6. In this aspect, the textile also has a weave texture structure where a warp TA made of the main-yarn 12 and a weft WA made of the main-yarn 12 are interwoven with a warp TB made of the sub-yarn 14 and a weft WB made of the sub-yarn 14. Focusing only on both the warp TA and the weft WA in this weave texture structure, they cross each other in a twill weave texture structure. Warp rows have a repeating row structure where one warp TB is located between two warps TA; whereas weft rows have a repeating row structure where one weft WB is located between two wefts WA. In addition, the value of t/P is 1/8.

The textile according to the weave texture chart 10*b* has no float of the sub-yarn 14 in which the number of skipped yarns is 3 or more. This also contributes to substantially equal longitudinal and traverse tensile elasticities in the textile to provide favorable balance, and further contributes to high shear elasticity in the plane direction, dimensional stability, and the above-mentioned balanced longitudinal and traverse tensile elasticities as described above. This also contributes to good shape stability of the textile.

In the weave texture charts 10*a* and 10*b* with such configurations, the increased weave density also realizes a structure where the main-yarns 12 are located so as to cover the surface of the textile and the sub-yarns 14 are located at the center of the textile in the thickness direction. In the same manner as in the textile 16 illustrated in FIG. 3, the textures have preferred deformation characteristics to make a curved surface suitable for the upper 4, i.e., high bending elasticity, particularly high shear elasticity in the plane direction, and the above-mentioned balanced longitudinal and traverse tensile elasticities as described above. In addition to these, the textiles have a structure where the main-yarns 12 are located so as to cover the surface of the textile, as described above, and thus the main-yarn 12 excellent in moisture absorption properties is used in direct contact with runners' foot. This can avoid the trouble that the moisture in shoes during sports softens the skin to produce corns followed by breaking of corns or so.

It should be noted that FIGS. 2, 5, and 6 are intended to illustrate the weave textures and thus the relationship between the yarn size and the yarn interval and the like are different from actual textiles in order to clarify the weave texture.

In the textile of the present invention, the main-yarn (warp A) located as the warp and the main-yarn (weft A) located as the weft form a plain weave texture structure or a twill weave texture structure (focusing only on the main-yarns, the warp A and the weft A form a plain weave texture structure or a twill weave texture structure) in this way, wherein warp rows have a repeating row structure where m (m=1 or 2) warps B made of the sub-yarn are located between two warps made of the main-yarn, and weft rows have a repeating row structure where n (n=1 or 2) wefts B made of the sub-yarn are located between two wefts made of the main-yarn. When m=n, it is preferred in terms of the balance of the longitudinal and traverse tensile elasticities and the bending elasticity. When both m and n or one of m and n=3 or more, the ratio of the main-yarn exposed on the textile surface decreases to increase the frequency of direct contact of the sub-yarn with runners' foot and thus to cause moisture feeling. This also damages the foot.

When the textile of the present invention has t/P of 1/15 to 1/4, it is preferred to satisfy both the smoothness of the textile and the preferred deformation characteristics described above. When t/P is less than 1/15, the ratio of the main-yarn exposed on the surface is too low to obtain a smooth surface. When t/P is over 1/4, the durability and the dimensional stability are poor. The t/P of 1/10 to 1/6 is more preferred to satisfy both the smoothness of the textile and the preferred deformation characteristics described above.

It is still more preferred that the textile of the present invention has no float, in which the number of skipped yarns is 3 or more, of the sub-yarn on one side in the unit area, in order to obtain substantially equal longitudinal and traverse tensile elasticities in the textile to provide favorable balance, and to obtain dimensional stability, high shear elasticity in the plane direction, and the above-mentioned balanced longitudinal and traverse tensile elasticities described above. It is most preferred that there be no float of the sub-yarn in which the number of skipped yarns is 3 or more in the unit area in terms of the above points.

The yarn density (weave density) of the textiles of the present invention having the weave textures illustrated in the weave texture charts 10, 10*a*, and 10*b* is preferably relatively higher than those of ordinary textiles as described above. It is preferred that the weave density coefficient K of the textile be 8.5 or more in order to increase the ratio of the Japanese paper yarn, as the main-yarn, exposed on the textile surface. When the weave density coefficient K is over 14, the textile approaches to the limit of difficulty in weavability. It is thus preferred that the weave density coefficient K be 8.5 to 14. It is more preferred that the weave density coefficient K be 9.5 to 14, in order to locate the main-yarn 12 so as to cover the surface of textile.

In the present invention, the weave density coefficient K of the textile is defined as $K=W\times\sqrt{G}$. In the formula, W is a value defined as $W=(W_1+W_2)/2$, where $W_1$ represents the warp density (the number of warps/25.4 mm) and $W_2$ represents the weft density (the number of wefts/25.4 mm). G is a value (arithmetic mean) defined as $(4\times G_1+G_2\times(m+n))/(4+m+n)$, wherein $G_1$ (g/m) represents the linear density of the main-yarn (Japanese paper yarn) and $G_2$ (g/m) represents the linear density of the sub-yarn. When m=n=2, $G=(G_1+G_2)/2$. The warp density is a value indicating the number of warps (warp A+warp B) per traverse unit width of the textile. The weft density is a value indicating the number of wefts (weft A+weft B) per longitudinal unit width of the textile.

In the calculation of G, by using the arithmetic mean of the warps and the wefts as the mean of the linear density, the arithmetic mean was found to be more reflective of the linear density of the main-yarn than the geometric mean or the harmonic average (the arithmetic mean of the yarn number count), which is more realistic.

When the main-yarn is mixed with Japanese paper yarns of different yarn number counts, $G_1$ is the arithmetic mean of the linear densities for the entire main-yarn. The same applies to $G_2$ of the sub-yarn.

In the present invention, the value of $2\times|W_1-W_2|/(W_1+W_2)$, which indicates the degree of deviation of the warp density and the weft density, is more preferably from 0 to 0.15 in order to improve the balance of the longitudinal and traverse tensile elasticities and the bending elasticity of the textile.

The weave texture structure in the present invention is favorable as the texture structure of the mixed textile using the main-yarn 12 and the sub-yarn 14 having a lower linear density than the main-yarn 12. This weave texture structure provides the textile of the present invention having excellent moisture absorption properties, dimensional stability, and durability as well as good texture. The use of this textile can provide running shoes which cause less damage on the foot.

With regard to this weave texture structure, the entire textile preferably has this weave texture structure, but even if a part of the entire textile has a different weave texture structure from this weave texture structure, the aforementioned effects of the present invention as described above are obtainable when the area of the part having a different weave texture structure from the above weave texture structure occupies 20% or less of the area of the entire textile. Examples of the different weave texture structure from this weave texture structure include a weave texture structure where a different type of yarn from the main-yarn or the sub-yarn is located in a lattice-like manner or a banded manner with a predetermined interval, for example, of 5 mm or more in the textile having the weave structure of the textile of the present invention; and a weave texture structure where a strip-shaped part of the texture structure having 5 mm or less of the width of a different weave texture structure from this weave texture structure is located in a lattice-like manner or a banded manner with a predetermined interval, for example, of 5 mm or more in the textile having the weave structure of the textile of the present invention. The textiles in these aspects are also substantially included within the scope of the textile of the present invention.

The textile of the present invention can be suitably used not only for uppers of athletic running shoes, but also for uppers of general shoes such as trekking shoes, sports shoes, business shoes, new boots, sandals-like shoes, rubber-soled cloth footgear-like shoes, and casual shoes, to prove shoes which have excellent moisture absorption properties, dimensional stability, and durability as well as good texture and cause less damage on the foot. In addition, the textile of the present invention can provide preferred deformation characteristics to make a curved surface suitable for an upper, i.e., high bending elasticity and particularly high shear elasticity in the plane direction. The textile of the present invention can further obtain the balance of the longitudinal and traverse tensile elasticities and the bending elasticity which are more preferred deformation characteristics to make a curved surface suitable for an upper. This upper can obtain a smooth surface.

When the textile of the present invention is used as an upper of shoes such as running shoes, this textile may be attached to a sheet fabric such as a cloth or a filmy material in order to impart additional functions such as reinforcement, decoration, and protection. As this sheet fabric, knitted fabrics, woven fabrics, leathers, artificial leathers, and the like may be used.

When the Japanese paper used in the textile of the present invention is mixed with a fiber of bamboo grass, antibacterial properties can be imparted to the shoes to give the effect of reducing irritation of the foot.

The textile of the present invention can be suitably used not only for an upper of shoes but also as fabric members of footwear including sandals and slippers, by taking advantage of characteristics of excellent moisture absorption properties, dimensional stability, and durability and good texture as well as less damage on the foot.

The textile of the present invention can also be suitably used as materials which are used as bag materials or surface materials for the bag part of bags such as handbags and pochettes. The textile of the present invention can also be suitably used as materials for the storage part, the surface part, and the like of cases such as wallets and card cases. Furthermore, the textile of the present invention can be used for materials for hats or wigs and garments as fabrics. They have excellent moisture absorption properties, dimensional stability, and durability, and have natural, smooth, comfortable, and favorable texture which is not obtained from fabric clothes made of synthetic fibers, or from cotton clothes.

The textile of the present invention can be used as article materials for interiors and interior materials for movable bodies, such as curtain fabrics, wallpapers, covering clothes for furniture and interior members for movable bodies such as automobiles to provide materials which have excellent moisture absorption properties, dimensional stability, and durability and also have natural, smooth, comfortable, and favorable texture which is not obtained from conventional fabric clothes made of synthetic fibers, or from cotton clothes. These materials have a deodorization property and thus have the effect of reducing odors in rooms and storage spaces. When the Japanese paper used in the textile of the present invention is mixed with fiber of bamboo grass, these materials further increase the effect of reducing odors in rooms.

When the textile of the present invention is used as such article materials for interiors, this textile may be attached to a sheet fabric such as a cloth or a filmy material in order to impart additional functions such as reinforcement, decoration, and protection. As this sheet fabric, knitted fabrics, woven fabrics, leathers, artificial leathers, films, and the like may be used.

In addition, the textile of the present invention may include a yarn containing a fiber having heat-fusion property as the sub-yarn. The heat-fusible fiber is a fiber made of a polymer melted by heating, or a fiber in which a polymer melted by heating is located so as to be exposed on at least a part of the surface of the fiber. Specifically, the textile of the present invention may have an aspect that the sub-yarn includes a heat-fusible fiber, the heat-fusible fiber includes a hot-melt polymer and the heat-fusion property of the heat-fusible fiber is exhibited by melting the hot-melt polymer. In this aspect, the main-yarn and the sub-yarn are woven to obtain a textile, and this textile is then heated to melt at least a part of this polymer constituting the fiber having heat-fusion property (heat-fusible fiber), whereby fusing these adjacent heat-fusible fibers or fibers or yarns adjacent to this heat-fusible fiber through this heat-fusible fiber. This allows the textile of the present invention to have a very few frays of constituting yarns.

The textile of the present invention may also include a composite yarn containing a Japanese paper tape and a yarn including a heat-fusible fiber as the main-yarn. Specifically, the textile of the present invention may have an aspect that the main-yarn is a composite yarn containing a Japanese paper tape and a heat-fusible fiber, the heat-fusible fiber includes a hot-melt polymer and the heat-fusion property of the heat-fusible fiber is exhibited by melting the hot-melt polymer. In this aspect, the textile is obtained by weaving this main-yarn and the sub-yarn, and this textile is then heated to melt at least a part of the heat-fusible fiber, thereby fusing adjacent heat-fusible fibers or fibers or yarns adjacent to this heat-fusible fiber. This allows the textile of the present invention to have a very few frays of constituting yarns. As composite aspects of this composite yarn, plying and covering may be mentioned.

The textile of the present invention containing the heat-fusible fiber in these aspects hardly causes fray of a cut end. When the textile is used after cutting into a predetermined shape, the textile can be used as it is after the cutting without requiring sewing the cut end or so to prevent fray, which can simplify and rationalize this processing process. For example, the textile of the present invention in such aspects can be suitably used as insoles of shoes. Specifically, the main-yarn and the sub-yarn including a fiber having heat-fusion property are interwoven to obtain a textile, and this textile is then heated to melt the fiber having heat-fusion property (heat-fusible fiber), whereby providing the textile of the present invention which can be suitably used as insoles of shoes. In this case, the use of heat pressing with a predetermined die as a heater, together with cutting (trimming), can provide a curved-surface shape or a surface shape which is suitable as insoles, and also can efficiently carry out punching.

A hot roll may be used as a heater. The surface may be subjected to raised and recessed pattern formation by embossing the surface with this hot roll.

An insole is an inner part of shoes which contacts the sole of the foot and is detachably located at the bottom of shoes in use, or a part integrally incorporated into a shoe sole part.

Melting the fiber having heat-fusion property (heat-fusible fiber) by the above heating fuses adjacent yarns in the textile or fibers constituting the yarn or binds them to each other by the anchor effect, through the heat-fusible fiber. This provides the textile of the present invention having the characteristics of the cut end being hardly frayed.

Examples of the hot-melt polymer constituting the heat-fusible fiber include thermoplastic resins, such as polyester fibers, polyamide fibers, and polyolefin fibers. As the sub-yarn, a thread containing two kinds of fibers having different melting points may be used. In this case, it is preferred that heating the textile at temperatures between these different melting points causes the fiber having a lower melting point to function as the heat-fusible fiber. In this aspect, the fiber having a higher melting point is not melted by this heating to substantially keep the strength, and thus the strength of the textile is not largely impaired by this heating.

When the heat-fusible fiber is made of one kind of polymer having a melting point of T° C., the heating temperature H of the textile preferably satisfies $T \leq H \leq T+3$° C. in order to avoid the strength of the textile from being largely impaired by this heating.

Moreover, the heat-fusible fiber may be a fiber including two kinds of resins having different melting points in combination in a core-sheath or bimetal manner. In this aspect, the textile is also heated at temperatures between these different melting points, and the resin having a higher melting point is not melted by this heating to substantially keep the strength, and thus the strength of the textile is not largely impaired by this heating.

The heat-fusible fiber may be a filament, or may be a staple. When the heat-fusible fiber is a filament, it may be interwoven with different filament(s) before use, or combined or twisted with different thread(s) before use. When the heat-fusible fiber is a staple, it may be mixed with different fiber(s) before use.

When the textile of the present invention is used as an insole, this textile may be attached to a sheet fabric such as a cloth or a filmy material in order to impart additional functions such as reinforcement, decoration, and protection. As this sheet fabric, knitted fabrics, woven fabrics, leathers, artificial leathers, thermoplastic films, and the like may be used.

For the textile of the present invention in this aspect, respective edges of two cloths can be easily joined together using a heating joining device such as a high-frequency wave sewing machine without sewing.

The textile of the present invention of such an aspect can be suitably used not only as insoles, but also as footwear materials for footwear including sandals and slippers; article materials for interiors and interior materials for movable bodies, such as curtain fabrics, wallpapers, covering clothes for furniture and interior members for movable bodies such as automobile; materials used for the bag part of bags such as handbags and pochettes as bag materials or surface materials; materials or surface materials for the storage part of cases such as wallets and card cases; and further fabrics for garments, by taking advantage of absence of the fray described above and favorable processability to join the edges by heating. These materials have excellent moisture absorption properties and particularly excellent dimensional stability and durability, and have natural, smooth, comfortable, and favorable texture which is not obtained from fabric clothes made of leathers or synthetic fibers, or from cotton clothes. These materials have deodorization property and thus have the effect of reducing odors in rooms, cars, and storage spaces. They can obtain a very smooth surface by pressing or the like, or a specifically raised and recessed surface.

When the textiles of these aspects in the present invention are used for these applications, these textiles may be attached to a sheet fabric such as a cloth or a filmy material in order to impart additional functions such as reinforcement, decoration, and protection. As this sheet fabric, knitted fabrics, woven fabrics, leathers, artificial leathers, films, and the like may be used.

The textile of the present invention containing the heat-fusible fiber preferably includes 5 to 60% by weight of the heat-fusible fiber with respect to the weight of the Japanese paper in the textile. When the content of the heat-fusible fiber is below this range, the effect of preventing the cut end from being frayed is insufficient. When the content of the heat-fusible fiber is over this range, the rigidity of the textile is extremely increased by exhibition of the fusion effect of the entire heat-fusible fiber. In terms of these points, 20 to 40% by weight of the heat-fusible fiber is preferably included with respect to the weight of the Japanese paper in the textile.

EXAMPLES AND COMPARATIVE EXAMPLES

The following products were produced from the textiles obtained in Examples and Comparative Examples.

(1) Running shoes using the textiles as uppers (Examples 1 to 4, Comparative Examples 1 to 4)
(2) Wallet (Example 5)
(3) Ladies' shoes (Example 6)
(4) Handbag (Example 7)
(5) Suit (Example 8)
(6) Covering cloth for automobile seats (Example 9)
(7) Insole (Example 10)
(8) Sandal (Example 11)

[Type of Japanese Paper Yarn]

Japanese paper yarn 1: Japanese paper yarn (yarn number count of 31 (metric count); the number of twists: Z 470 T/m) obtained by slitting Japanese paper into a tape shape and twisting the tape-shaped Japanese paper wherein the Japanese paper is produced by papermaking using a Japanese paper material.

Japanese paper yarn 2: Japanese paper yarn (yarn number count of 32 (metric count); the number of twists: Z 500 T/m) obtained by slitting Japanese paper into a tape shape and twisting the tape-shaped Japanese paper wherein the Japanese paper is produced by papermaking using a Japanese paper material.

Japanese paper yarn 3: Japanese paper yarn obtained by twisting together (the number of twists: Z 470 T/m) a 30 denier polyester filament yarn and a non-twisted, tape-shaped Japanese paper (yarn number count of 35 (metric count)) obtained by slitting Japanese paper wherein the Japanese paper is produced by papermaking using a Japanese paper material.

Japanese paper yarn 4: Japanese paper yarn (yarn number count of 40 (metric count); the number of twists: Z 750 T/m) obtained by slitting Japanese paper into a tape shape and twisting the tape-shaped Japanese paper wherein the Japanese paper is produced by papermaking using a Japanese paper material.

Japanese paper yarn 5: Japanese paper yarn (yarn number count of 30 (metric count); the number of twists: Z 650 T/m) obtained by slitting a Japanese paper into a tape shape and twisting the tape-shaped Japanese paper wherein the Japanese paper is produced by papermaking using a Japanese paper material.

Example 1

Japanese paper yarn 1 as the main-yarn 75 denier polyester filament yarn as the sub-yarn; the number of twists: 110 T/m Warp density: 324 warps/10 cm, Weft density: 307 wefts/10 cm Weave texture: FIG. 2

Weave density coefficient: 11.4

Example 2

Japanese paper yarn 2 as the main-yarn 100 denier polyester filament yarn as the sub-yarn; the number of twists: 130 T/m Warp density: 290 warps/10 cm, Weft density: 284 wefts/10 cm Weave texture: FIG. 5

Weave density coefficient: 10.6

Example 3

Japanese paper yarn 3 as the main-yarn 75 denier polyester filament yarn as the sub-yarn; the number of twists: 110 T/m Warp density: 296 warps/10 cm, Weft density: 290 wefts/10 cm Weave texture: FIG. 2

Weave density coefficient: 10.6

Example 4

Japanese paper yarn 2 as the main-yarn 150 denier polyester filament yarn as the sub-yarn; the number of twists: 110 T/m Warp density: 296 warps/10 cm, Weft density: 290 wefts/10 cm Weave texture: FIG. 6

Weave density coefficient: 11.5

Comparative Example 1

Main-yarn used in Example 1 as the warp and the weft

Warp density: 288 warps/10 cm

Weft density: 284 wefts/10 cm

Weave texture: plain weave

Weave density coefficient: 10.3

Comparative Example 2

Main-yarn used in Example 1 as the warp
Sub-yarn used in Example 1 as the weft
Warp density: 220 warps/10 cm, Weft density: 300 wefts/10 cm
Rough texture with notably raised and recessed surface
Weave texture: plain weave Comparative Example 3

As the warp and the weft, a 150 denier polyester filament yarn (the number of twists: 130 T/m) was used.
Warp density: 292 warps/10 cm
Weft density: 288 wefts/10 cm
Weave texture: plain weave
Weave density coefficient: 9.5

Comparative Example 4

20/2s cotton yarn as the warp and the weft
Warp density: 156 warps/10 cm
Weft density: 152 wefts/10 cm
Weave texture: plain weave
Weave density coefficient: 9.5

[Evaluation Test for Examples 1 to 4, Comparative Examples 1 to 4]

Active marathon runners were divided into eight groups of three persons as monitors. Each group was assigned to wear running shoes using the textiles of Examples or Comparative Examples as an upper during training. After a total running distance of 100 km, the moisture feeling, the damage on the foot, and the damage of the upper were all evaluated for each group. It is noted that the runners stop wearing the running shoes at the time of causing a running problem in an evaluation test for the damage on the foot and the damage of the upper.

[Evaluation Criteria for Examples 1 to 4, Comparative Examples 1 to 4]

Moisture Feeling:
○: No moisture feeling during use.
Δ: Some moisture feeling.
X: Soggy feeling due to the moisture inside the shoes during use.

Damage on Foot:
○: No damage on the foot after running the total running distance of 100 km.
Δ: Corns were formed after 50 km or longer run.
X: Foot skin was chafed after 50 km or longer run.

Damage of Upper:
○: No damage during use.
Δ: Shape deformation of the upper was observed.
X: The upper was damaged.

Rough texture of surface: evaluated as presence or absence.

Evaluation Results of Examples 1 to 4, Comparative Examples 1 to 4

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Moisture feeling | ○ | ○ | ○ to Δ | ○ to Δ | ○ | Δ | x | ○ to Δ |
| Damage on foot | ○ | ○ | ○ | ○ | ○ to Δ | x | x | x |
| Damage of upper | ○ | ○ to Δ | ○ | ○ to Δ | Δ to x | ○ | ○ to Δ | x |
| Rough texture of surface | absence | absence | absence | absence | absence | presence | absence | absence |

From Table 1, the running shoes of the present invention exhibit the performance satisfying all criteria of the moisture feeling, the damage on the foot, and the damage of the upper (durability), and also have a smooth surface to give foot comfort.

Example 5

A wallet was produced using the textile obtained in Example 1 as a surface material of a storage part. The wallet had natural texture and smooth feel which were not obtained from leather products, and no shape deformation was observed even after one year or longer of use.

Example 6

Ladies' shoes (pumps) were produced using the textile obtained in Example 1 as an upper material. The shoes had a natural texture and smooth feel which were not obtained from leather products, and also had no moisture feeling during wearing, and no shape deformation was observed even after one year or loner of use in typical aspects.

Example 7

A handbag was produced using the textile obtained in Example 1 as a bag member. The handbag had natural texture and smooth feel which were not obtained from leather products, and no shape deformation was observed even after one year or loner of use.

Example 8

A suit for spring and summer was produced using the textile obtained in Example 3. The suit had natural texture and smooth feel which were not obtained from conventional suit fabrics, and no shape deformation was observed even after one season of use. The washing resistance was also excellent.

Example 9

Japanese paper yarn 4 as the main-yarn
50 denier polyester filament textured yarn as the sub-yarn; the number of twists: 1,000 T/m Warp density: 463 warps/10 cm, Weft density: 425 wefts/10 cm Weave texture: FIG. 6

The textile obtained in Example 9 was used as a covering cloth for automobile seats. The automobile seat using this covering cloth had natural, smooth, comfortable, and favorable texture which was not obtained from fabric clothes made of synthetic fibers, or from cotton clothes. In addition, the automobiles each using this seat had less internal odor than conventional automobiles.

Example 10

Japanese paper yarn 5 as the main-yarn 54 dtex 24 fil polyester special filament yarn (Trade name MELSET, produced by Unitika Trading Co., Ltd.) as the sub-yarn; the number of twists: Z 800 T/m Warp density: 429 warps/10 cm, Weft density: 393 wefts/10 cm Weave texture: FIG. 2

Note: MELSET is a multifilament yarn made of a fiber having a core-sheath structure including a regular polyester as a core and a polyester with a low melting point (180° C.) as a sheath.

The textile obtained with this configuration was subjected to fixed-length thermosetting at 190° C. for 2 minutes using a tenter to obtain a fabric cloth. This fabric cloth was punched out into the shape of an insole with a punching machine. The edge had no fray after punching out and the punched-out insole was successfully used as an insole as it was. This insole had natural, smooth, comfortable, and favorable texture which was not obtained from fabric clothes made of synthetic fibers, or from cotton clothes. The odor in the shoes after use was reduced as compared with the use of conventional leather insoles.

Example 11

The fabric cloth obtained in Example 10 was cut into a predetermined shape as a sandal material. The cut end has no fray and the fabric cloth was successfully processed into a predetermined sandal form. This sandal had natural, smooth, comfortable, and favorable texture which was not obtained from fabric clothes made of synthetic fibers, or from cotton clothes.

The textile of the present invention can be applied to various fields such as daily necessities, furniture, interior materials, interior materials for automobiles, and garments, by taking advantages of durability, and natural, smooth, comfortable texture which is not obtained from fabric clothes made of leather or synthetic fibers, or from cotton clothes.

There has thus been shown and described a novel textile which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A textile comprising:

a main-yarn; and a sub-yarn, the main-yarn and the sub-yarn being interwoven with each other, the main-yarn being a yarn including 50% by weight or more of Japanese paper which is slit into a tape shape, the Japanese paper being made from a paper material including 90% or more of fibers obtained from at least one of paper mulberry, oriental paper bush, hemp, conifer, and bamboo grass, and the Japanese paper having a weight per unit area in a range of 10 to 20 $g/m^2$, the sub-yarn being a yarn made of natural fiber for spinning and weaving, or made of artificial fiber, the sub-yarn having a weight per unit length that is 1/7 to 2/3 of the weight per unit length of the main-yarn, the textile having a weave texture structure including a warp A made of the main-yarn, a weft A made of the main-yarn, a warp B made of the sub-yarn, and a weft B made of the sub-yarn, in the weave texture structure, warp rows having a repeating row structure where one or two warps B are located between two warps A, weft rows having a repeating row structure where one or two wefts B are located between two wefts A, and the warp A and the weft A crossing each other in one of a plain weave texture structure and a twill weave texture structure in the texture, the textile having a weave density coefficient of 8.5 to 14, the weave density coefficient being defined as $K=W\times\sqrt{G}$, with W being a value defined as $W=(W_1+W_2)/2$, where $W_1$ represents a warp density of the textile and $W_2$ represents a weft density of the textile, and G being a value defined as $(4\times G_1+G_2\times(m+n))/(4+m+n)$, where $G_1$ represents a linear density of the main-yarn, $G_2$ represents a linear density of the sub-yarn, m represents a number of warps made of the sub-yarn located between two warps of the main-yarn, and n represents a number of wefts made of the sub-yarn located between two wefts of the main-yarn, and the textile having a value of t/P of 1/15 to 1/4 where P represents a product of the number of warps and the number of wefts, the warps and the wefts being present in a unit area of the textile, and t represents the number of floats in which the number of skipped yarns by the main-yarn is 3 to 4, the floats being present on one side of the unit area.

2. The textile according to claim 1, wherein a value of $2\times|W_1-W_2|/(W_1+W_2)$ is 0 to 0.15.

3. The textile according to claim 1, wherein the sub-yarn includes a heat-fusible fiber, the heat-fusible fiber includes a hot-melt polymer, and a heat-fusion property of the heat-fusible fiber is exhibited by melting the hot-melt polymer.

4. The textile according to claim 1, wherein the main-yarn is a composite yarn containing the Japanese paper and a heat-fusible fiber, the heat-fusible fiber includes a hot-melt polymer, and a heat-fusion property of the heat-fusible fiber is exhibited by melting the hot-melt polymer.

5. The textile according to claim 3, wherein the heat-fusible fiber is a composite fiber of the hot-melt polymer and a high melting point polymer having a higher melting point than the hot-melt polymer, and the composite fiber is a composite fiber obtained by combining the high melting point polymer and the hot-melt polymer in one of a core-sheath structure and a bimetal structure.

6. A textile obtained by heating the textile according to claim 3 at a temperature at which the hot-melt polymer melts.

7. A fabric member for footwear, using the textile according to claim 1.

8. A shoe using the textile according to claim 1 for an upper.

9. A sandal using the textile according to claim 1 for a fabric member.

10. A bag using the textile according to claim 1 for a bag part.

11. A case using the textile according to claim 1 for a storage part.

12. A garment using the textile according to claim 1 as a fabric.

13. An interior material for movable bodies, using the textile according to claim 1 as a fabric.

14. An insole using the textile according to claim 1 as a fabric.

15. An article material for interiors, using the textile according to claim 1 as a fabric.

16. The textile according to claim 4, wherein the heat-fusible fiber is a composite fiber of the hot-melt polymer and a high melting point polymer having a higher melting point than the hot-melt polymer, and the composite fiber is a composite fiber obtained by combining the high melting point polymer and the hot-melt polymer in one of a core-sheath structure and a bimetal structure.

17. A textile obtained by heating the textile according to claim 4 at a temperature at which the hot-melt polymer melts.

18. A textile obtained by heating the textile according to claim 5 at a temperature at which the hot-melt polymer melts.

* * * * *